US010116040B2

(12) United States Patent
Li

(10) Patent No.: US 10,116,040 B2
(45) Date of Patent: Oct. 30, 2018

(54) MULTI-FREQUENCY ANTENNA AND TERMINAL

(71) Applicant: ZTE Corporation, Shenzhen (CN)

(72) Inventor: Qun Li, Shenzhen (CN)

(73) Assignee: ZTE Corporation, Shenzhen, Guangdong (CN)

( * ) Notice: Subject to any disclaimer, the term of this patent is extended or adjusted under 35 U.S.C. 154(b) by 31 days.

(21) Appl. No.: 15/023,756

(22) PCT Filed: Apr. 18, 2014

(86) PCT No.: PCT/CN2014/075721

§ 371 (c)(1),
(2) Date: Apr. 12, 2016

(87) PCT Pub. No.: WO2015/039435

PCT Pub. Date: Mar. 26, 2015

(65) Prior Publication Data

US 2016/0233576 A1 Aug. 11, 2016

(30) Foreign Application Priority Data

Sep. 22, 2013 (CN) ..... 2013 1 0438081

(51) Int. Cl.
*H01Q 1/24* (2006.01)
*H01Q 5/371* (2015.01)
(Continued)

(52) U.S. Cl.
CPC ..... *H01Q 1/243* (2013.01); *H01Q 5/371* (2015.01); *H01Q 7/00* (2013.01); *H01Q 9/0421* (2013.01)

(58) Field of Classification Search
CPC ..... H01Q 1/243; H01Q 5/371; H01Q 9/0421; H01Q 7/00
See application file for complete search history.

(56) References Cited

U.S. PATENT DOCUMENTS 7,626,551 B2 12/2009 Chien
8,487,814 B2 7/2013 Wang
(Continued)

FOREIGN PATENT DOCUMENTS

CN 2593384 Y 12/2003
CN 1518783 A 8/2004
(Continued)

OTHER PUBLICATIONS

International Search Report in international application No. PCT/CN2014/075721, dated Jul. 29, 2014.
(Continued)

*Primary Examiner* — Jessica Han
*Assistant Examiner* — Michael Bouizza
(74) *Attorney, Agent, or Firm* — Oppedahl Patent Law Firm LLC

(57) ABSTRACT

The present disclosure discloses a multi-frequency antenna and a terminal. An antenna body of the multi-frequency antenna includes: a grounding part, a feed part, and a first radiation branch arm and a second radiation branch arm which are connected with the feed part; the antenna body further includes a third radiation branch arm; one end of the third radiation branch arm is connected with the feed part, and the other end of the third radiation branch arm is connected with the grounding part.

15 Claims, 3 Drawing Sheets

(51) Int. Cl.
*H01Q 7/00* (2006.01)
*H01Q 9/04* (2006.01)

(56) References Cited

U.S. PATENT DOCUMENTS

| | | | | |
|---|---|---|---|---|
| 2004/0246180 | A1* | 12/2004 | Okado | H01Q 1/243 343/700 MS |
| 2009/0040110 | A1 | 2/2009 | Chien | |
| 2010/0171676 | A1* | 7/2010 | Tani | H01Q 1/243 343/803 |
| 2011/0227805 | A1 | 9/2011 | Wang | |
| 2012/0176291 | A1* | 7/2012 | Hsueh | H01Q 5/371 343/843 |
| 2013/0214985 | A1* | 8/2013 | Wolf | H01Q 1/243 343/843 |

FOREIGN PATENT DOCUMENTS

| | | | |
|---|---|---|---|
| CN | 1918920 | A | 2/2007 |
| CN | 2896550 | Y | 5/2007 |
| CN | 101420061 | A | 4/2009 |
| CN | 101997162 | A | 3/2011 |
| CN | 202042592 | U | 11/2011 |
| CN | 102751562 | A | 10/2012 |
| CN | 202474194 | U | 10/2012 |
| EP | 2418732 | A2 | 2/2012 |
| KR | 20110125560 | A | 11/2011 |

OTHER PUBLICATIONS

English Translation of the Written Opinion of the International Search Authority in international application No. PCT/CN2014/075721, dated Jul. 29, 2014.

* cited by examiner

MULTI-FREQUENCY ANTENNA AND TERMINAL

TECHNICAL FIELD

The present disclosure relates to the field of communications, and more particularly, to a multi-frequency antenna and a terminal.

BACKGROUND

An antenna is a necessary component in a communication system. The performance of the antenna is directly related to quality of receiving and transmission of signals. Particularly, the difficulty in design of antennas in a communication equipment terminal is increased day by day. With network pavement and application of Long Term Evolution (LTE), the antenna needs to cover a wider frequency band, and a larger space is required. However, at present various communication terminals, in particular mobile phone terminals, have been developed in lightening and thinning, minimizing and globalizing ways, and their aesthetic properties shall be considered meanwhile. Therefore, it is impossible to leave a large enough space for the antenna. A limited space would always directly result in insufficient bandwidth, and this is the biggest problem in the design of the antenna. To solve this problem, generally, a conventional method for expanding the bandwidth of the antenna is to increase parasitic units coupled with a main radiator to generate harmonic with a required frequency band. But this method will result in loss of bandwidth of part of the frequency band.

SUMMARY

To solve conventional technical problems, embodiments of the present disclosure provide a multi-frequency antenna and a terminal.

To solve the above technical problem, a multi-frequency antenna is provided, which includes an antenna body. The antenna body includes: a grounding part, a feed part, and a first radiation branch arm and a second radiation branch arm which are connected with the feed part; and the antenna body further includes a third radiation branch arm; one end of the third radiation branch arm is connected with the feed part, and other end of the third radiation branch arm is connected with the grounding part.

In one embodiment of the present disclosure, one end of the first radiation branch arm and one end of the second radiation branch arm may be connected in parallel with the feed part; another end of the first radiation branch arm and another end of the second radiation branch arm may extend respectively along an extending direction of the third radiation branch arm; after extending and corresponding bending are completed, the first radiation branch arm and the second radiation branch arm may be combined to form an inverted G shape.

In one embodiment of the present disclosure, an electrical length of the second radiation branch arm may be greater than that of the first radiation branch arm.

In one embodiment of the present disclosure, an electrical length of the first radiation branch arm may be a quarter of a wavelength of a centre point of a first preset frequency band.

In one embodiment of the present disclosure, the first preset frequency band may be 1,710 MHz to 2,170 MHz.

In one embodiment of the present disclosure, the electrical length of the second radiation branch arm may be a quarter of a wavelength of a centre point of a second preset frequency band.

In one embodiment of the present disclosure, the second preset frequency band may be 824 MHz to 960 MHz.

In one embodiment of the present disclosure, an electrical length of the third radiation branch arm may be a quarter of a wavelength of a centre point of a third preset frequency band.

In one embodiment of the present disclosure, a clearance between the third radiation branch arm and the second radiation branch arm may be less than or equal to a first preset distance threshold value.

A terminal is further provided, which includes the above multi-frequency antenna.

The embodiment of the present disclosure has the beneficial effects:

The antenna body of the multi-frequency antenna and the terminal which are provided by the embodiment of the present disclosure includes the grounding part, the feed part, and the first radiation branch arm and the second radiation branch arm which are connected with the feed part, and further includes a third radiation branch arm; one end of the third radiation branch arm is connected with the feed part, and the other end of the third radiation branch arm is connected with the grounding part; that is, in the embodiment of the present disclosure, an extra loop serving as the third radiation branch arm is added between the feed part and the grounding part, and such loop can be configured to expand the bandwidth frequency band, to increase the bandwidth of the antenna, and will not result in loss of the bandwidth of part of the frequency band; moreover, the third radiation branch arm in the embodiment of the present disclosure can be further configured to assist in tuning the frequency band to a frequency band with a better standing-wave ratio.

BRIEF DESCRIPTION OF THE DRAWINGS

In the drawings (which are not drawn as per the proportion), similar drawing references can describe similar components in different views. Similar drawing references with different letter suffixes can represent different examples of similar components. Drawings substantially represent respective embodiments discussed in this text in a manner of examples instead of limitation.

DETAILED DESCRIPTION

Figure 1:
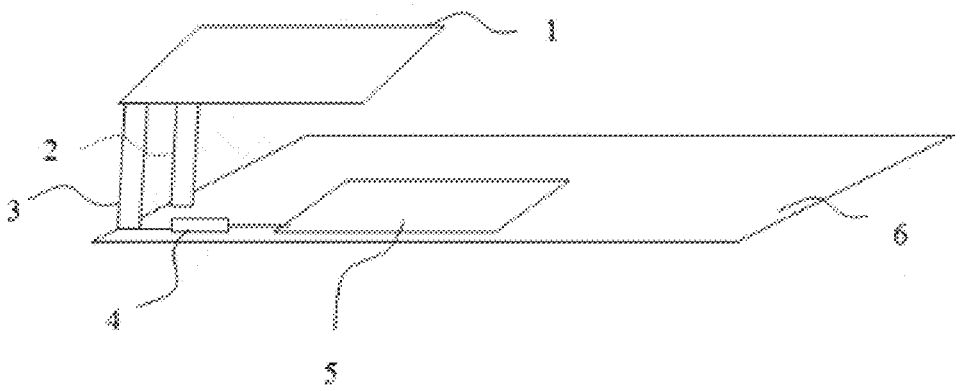
FIG. 1 is a structural diagram of a multi-frequency antenna according to embodiment II of the present disclosure.

Aiming at the problems of insufficient bandwidth of an existing antenna under the limitation of a finite space and loss of bandwidth of part of a frequency band during increase of the bandwidth, in various embodiments of the present disclosure: a loop serving as a third radiation branch arm is additionally arranged between a feed part (which is a signal feed point) and a grounding part (which is a grounding feed point) of an antenna body; the third radiation branch arm can be configured to expand the bandwidth frequency band, to increase the bandwidth of the antenna, and will not result in loss of the bandwidth of part of the frequency band; moreover, the third radiation branch arm can be configured to assist in tuning the frequency band to a frequency band with a better standing-wave ratio.

The present disclosure is further described below in detail in combination with specific implementation modes and drawings.

Embodiment I

The embodiment provides a multi-frequency antenna, which includes an antenna body. The antenna body includes a grounding part (which is a grounding feed point), a feed part (which is a signal feed point), and a first radiation branch arm and a second radiation branch arm which are connected with the feed part. One end of the first radiation branch arm and one end of the second radiation branch arm are connected in parallel with the feed part. The other end of the first radiation branch arm and the other end of the second radiation branch arm extend towards the same direction according to the specific type of the antenna, and are bent to form a corresponding type of antenna. In the embodiment, the antenna body further includes a third radiation branch arm. One end of the third radiation branch arm is connected with the feed part, that is, this end is connected in parallel with the first radiation branch arm and the second radiation branch arm. The other end of the third radiation branch arm is connected with the grounding part, to form a loop in front of the feed part and the grounding part. The formed loop can be configured to expand the frequency band. It can be seen that increase of the bandwidth of the antenna in the embodiment can be realized without increasing a parasitic unit, so that the problem of loss of the bandwidth of part of the frequency band can be avoided. In this embodiment, in certain specific application scenes, the third radiation branch arm can be further configured to assist in tuning the frequency band to a frequency band with a better standing-wave ratio.

In the embodiment, the other end of the first radiation branch arm and the other end of the second radiation branch arm extend respectively along the extending direction of the third radiation branch arm, and the first radiation branch arm and the second radiation branch arm form a corresponding type of antenna after extending a corresponding length and being correspondingly bent. For example, in the embodiment, the first radiation branch arm and the second radiation branch arm are combined to form an inverted G-shaped antenna after extending and bending. At that moment, the electrical length of the second radiation branch arm is greater than that of the first radiation branch arm, and the second radiation branch arm is close to the third radiation branch arm. The other end of the second radiation branch arm extends a certain length along the cabling direction of the third radiation branch arm, and then is backwards bent and extends a certain length again, to form an inverted U shape. The other end of the first radiation branch arm extends a certain distance along the cabling direction of the third radiation branch arm, to form an inverted G-shaped antenna with the second radiation branch arm.

In the embodiment, an electrical length of the first radiation branch arm, an electrical length of the second radiation branch arm and an electrical length of the third radiation branch arm can be specifically selected and set according to a specific application scene. For example, in this embodiment, the first radiation branch arm can be configured to generate a harmonic with a higher frequency band. The second radiation branch arm can be configured to generate harmonics with a sub-high frequency band and a low frequency band The third radiation branch arm can be specially configured to generate a harmonic with a frequency band to be expanded, or to assist in tuning the frequency band to a frequency band with a better standing-wave ratio. Correspondingly, the electrical length of the first radiation branch arm can be specifically set to be a quarter of a wavelength of the centre point of a first preset frequency band. The first preset frequency band at that time is a high frequency band, for example, which can be set as such a frequency band from 1,710 MHz to 2,170 MHz. The electrical length of the second radiation branch arm can be set to be a quarter of a wavelength of the centre point of a second preset frequency band. At that time, the second preset frequency band may be a sub-high frequency band or a low frequency band, for example, which can be set as such a frequency band from 824 MHz to 960 MHz. The electrical length of the third radiation branch arm can be set to be a quarter of a wavelength of the centre point of a third preset frequency band. At that time, the third preset frequency band may be a frequency band to be expanded at present, which can be selectively set according to a specific application scene.

In this embodiment, a clearance distance between the second radiation branch arm and the third radiation branch arm may affect migration of high-frequency-band harmonics because a coupling can be existed between the two radiation branch arms. And a size of a clearance between the second radiation branch arm and the third radiation branch arm may affect a strength of the coupling, which thus works on the harmonics generated by the whole radiation branch arms. Therefore, the clearance between the second radiation branch arm and the third radiation branch arm in the embodiment can be set to be less than or equal to a present distance threshold value. The preset distance threshold value can be specifically and selectively set to be, for example, 1 millimeter (mm), 2 mm and the like, according to a specific application scene.

The multi-frequency antenna in the embodiment includes a main board, and a radiation module (which is a radiation sheet) arranged on the main body. The antenna body is connected with the radiation module on the main board through its feed part. The grounding part of the antenna body is connected with the corresponding grounding feed point arranged on the main board.

In the embodiment, to better adjust the impedance of each wave band, the multi-frequency antenna can be further provided with a matching circuit. The feed part of the antenna body is connected with the radiation module through the matching circuit. The matching circuit adjusts the impedance of each wave band, so that the wave band has a better matching output, to realize optimal radiation.

Embodiment II

An antenna provided by this embodiment of the present disclosure can be suitable for various communication terminals, such as various mobile communication terminals of a mobile phone and an IPAD. To better understand the present disclosure, the present disclosure is further described below with the accompanying drawings by taking a specific antenna as an example.

With reference to FIG. 1, an antenna in this embodiment includes an antenna body 1, a matching circuit 4, a radio frequency module 5 and a main board 6. The antenna body 1 is connected to the main board 6 through a feed part 3 and a grounding part 2. The matching circuit 4 is arranged between the feed part 3 and the radio frequency module 5, and is configured to assist tuning of the antenna body 1.

Figure 2:
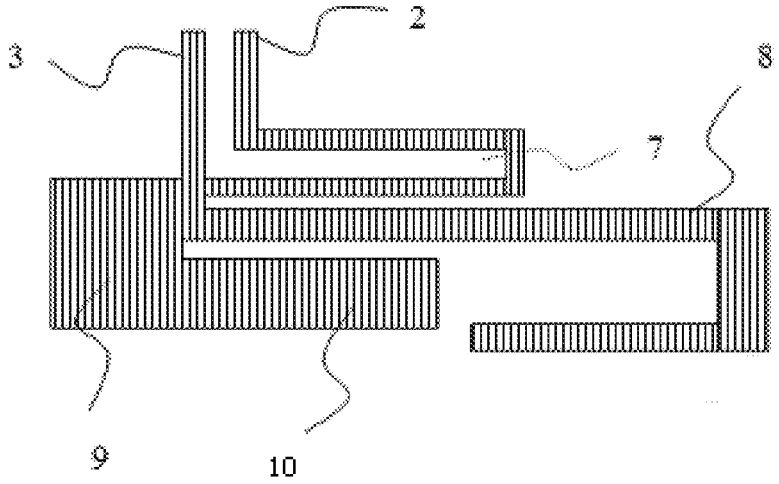
FIG. 2 is a structural diagram of an antenna body according to embodiment II of the present disclosure.
Figure 3:
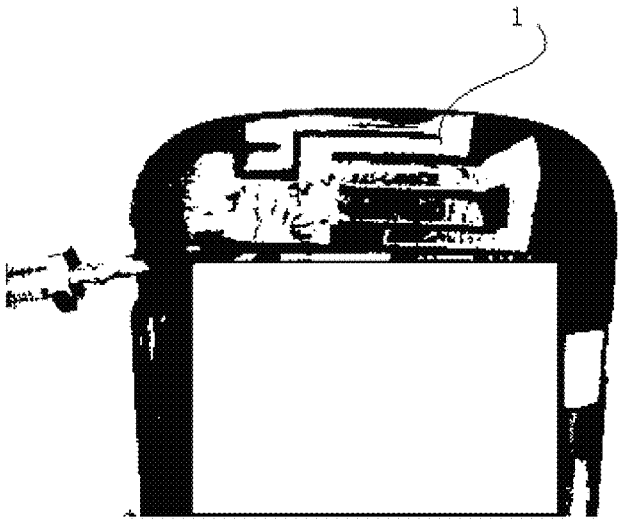
FIG. 3 is an entity diagram of an antenna body applied to a mobile phone terminal according to embodiment II of the present disclosure.

In the embodiment, the feed part 3 and the grounding part 2 of the antenna body 1 are respectively connected to the edge of the main board 6. With reference to FIG. 2, the antenna body 1 further includes a first radiation branch arm 10, a second radiation branch arm 8 and a third radiation branch arm 7. One end of the first radiation branch arm 10 and one end of the second radiation branch arm 8 are connected in parallel through a public part 9 to form a whole to be connected with the feed part 3. The other end of the second radiation branch arm 8 is led out of the public part 9 along the cabling direction of the third radiation branch arm 7. That is, the other end of the second radiation branch arm extends along the direction parallel to the third radiation branch arm 7 and downwards backwards bent after reaching a set length. The other end of the first radiation branch arm extends a certain length from the public part along the direction parallel to the third radiation branch arm 7 to form an inverted G shape with the second radiation branch arm 8. The first radiation branch arm 10 is configured to generate a harmonic with a higher frequency band. The second radiation branch arm 8 is configured to generate harmonics with a sub-high frequency band and a low frequency band. One end of the third radiation branch arm is connected with the feed part 3 through the public part 9, that is, this end is connected in parallel with the first radiation branch arm 10 and the second radiation branch arm 8. And the other end of the third radiation branch arm routes to the grounding part 2 in a bent manner after horizontally cabling to a certain extent, and is finally connected with the grounding part 2, thus finally forming a loop between the feed part 3 and the grounding part 2 to expand the bandwidth frequency band, or to assist in tuning the frequency band to a frequency band with a better standing-wave ratio. FIG. 3 is an entity diagram of an antenna body 1 which is shown in FIG. 2 and applied to a mobile phone.

Figure 4:
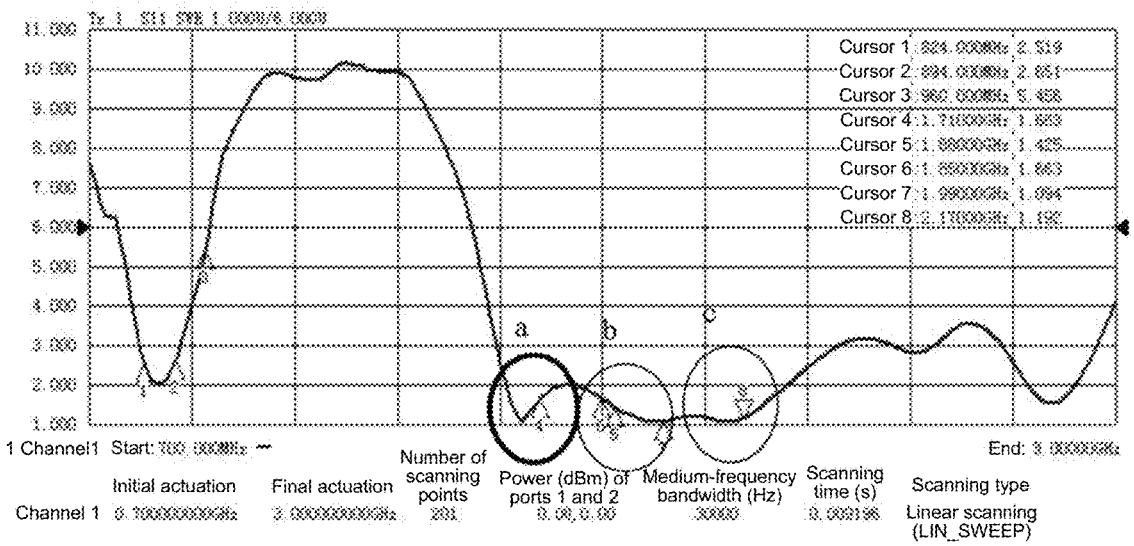
FIG. 4 is a diagram of a standing-wave ratio of an antenna according to embodiment II of the present disclosure.

In the embodiment, a clearance between the second radiation branch arm 8 and a third radiation branch arm 7 is set to be about 1 mm. The mainly tuned frequency band shown in FIG. 3 is assumed to be a low frequency band from 824 MHz to 960 MHz or a high frequency band from 1,710 MHz to 2,170 MHz. At that time, with reference to a diagram of a standing-wave ratio of an antenna in FIG. 4, it can be seen that there are three harmonic bands in the high frequency band. In the FIG. 4, a first harmonic band shown at a position b represented by a circle is mainly determined according to the electrical length of a first bend of the second radiation branch arm. A second harmonic band shown at a position a represented by a circle is mainly determined according to the electrical length of the first radiation branch arm, and a third harmonic band shown at a position c represented by a circle is mainly determined according to the electrical length of the third radiation branch arm. In addition, please see an antenna gain and efficiency sheet of Table I:

TABLE I

| Efficency | | | | | |
|---|---|---|---|---|---|
| Freq. (MHz) | Efficency | Average Gain (dBi) | Freq. (MHz) | Efficency | Average Gain (dBi) |
| 824 | 43% | −3.68 | 1910 | 43% | −3.71 |
| 840 | 42% | −3.72 | 1930 | 43% | −3.7 |
| 860 | 39% | −4.04 | 1950 | 43% | −3.69 |
| 880 | 33% | −4.76 | 1970 | 43% | −3.7 |
| 960 | 30% | −5.19 | 1990 | 43% | −3.71 |
| 1710 | 50% | −2.99 | 2010 | 42% | −3.72 |
| 1730 | 48% | −3.18 | 2030 | 42% | −3.8 |
| 1750 | 45% | −3.47 | 2050 | 41% | −3.89 |
| 1770 | 43% | −3.68 | 2070 | 41% | −3.87 |
| 1790 | 41% | −3.89 | 2090 | 41% | −3.84 |
| 1810 | 41% | −3.91 | 2110 | 41% | −3.84 |
| 1830 | 41% | −3.84 | 2130 | 41% | −3.88 |
| 1850 | 41% | −3.91 | 2150 | 41% | −3.92 |
| 1870 | 41% | −3.84 | 2170 | 40% | −3.97 |

In the table, the column of Freq. represents the frequency band. The column of Efficiency represents efficiency under each frequency band. The column of Average Gain represents an average gain under this frequency band; it can be seen that, at that time, the antenna has an extremely good bandwidth in the high frequency band, and can cover from 1,710 MHz to 3G; in addition, the efficiency is all above 40% (referring to the column of efficiency in Table I).

Figure 5:
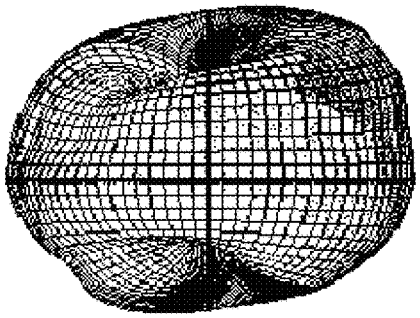
FIG. 5 is a directional radiation diagram of an antenna at a frequency point 880 MHz according to embodiment II of the present disclosure.
Figure 6:
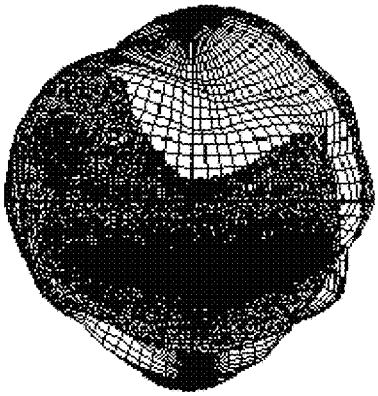
FIG. 6 is a directional radiation diagram of an antenna at a frequency point 1,710 MHz according to embodiment II of the present disclosure.
Figure 7:
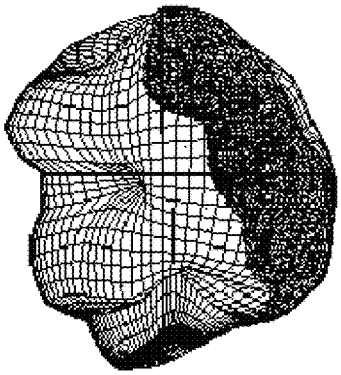
FIG. 7 is a directional radiation diagram of an antenna at a frequency point 2,170 MHz according to embodiment II of the present disclosure.

In addition, with reference to FIGS. 5-7, FIGS. 5-7 respectively shows directional radiation diagrams of the antenna in the embodiment under 880 MHz, 1,710 MHz and 2,710 MHz. It can be seen from each figure that the antenna provided by this embodiment is better in radiation in each direction in addition to a wider frequency band and higher efficiency. Therefore, various application scenes can be better met.

The above contents are to further describe the present disclosure in detail in combination with specific implementation modes, and do not limit specific implementation of the present disclosure to these descriptions. Those of common skill in the art can make various simple deductions or replacements to the present disclosure without departing from the spirit of the present disclosure. These deductions or replacements of the present disclosure shall fall within the scope of the present disclosure.

What is claimed is:

1. A multi-frequency antenna, comprising an antenna body, wherein the antenna body comprises: a grounding part, a feed part, and a first radiation branch arm and a second radiation branch arm which are connected with the feed part; and the antenna body further comprises a third radiation branch arm; one end of the third radiation branch arm being connected with the feed part, and other end of the third radiation branch arm being connected with the grounding part; wherein the third radiation branch arm is configured to generate a harmonic with a frequency band to be expanded, or to assist in tuning the frequency band to a frequency band with a better standing-wave ratio;

wherein a clearance between the third radiation branch arm and the second radiation branch arm is less than or equal to a first preset distance threshold value, and the clearance affects a strength of a coupling existed between the third radiation branch arm and the second radiation branch arm;

wherein one end of the first radiation branch arm and one end of the second radiation branch arm are connected in parallel through a public part to form a whole to be connected with the feed part; other end of the first radiation branch arm and other end of the second radiation branch arm are led out of the public part along a cabling direction of the third radiation branch arm; the other end of the second radiation branch arm extends a certain length along the cabling direction of the third radiation branch arm, and then is backwards bent and extends a certain length again to form an inverted U shape; and the other end of the first radiation branch arm extends a certain length from the public part along the direction parallel to the third radiation branch arm to form an inverted G shape with the second radiation branch arm;

wherein one end of the third radiation branch arm is connected with the feed part through the public part and then connected in parallel with the first radiation branch arm and the second radiation branch arm; and other end of the third radiation branch arm is connected with the grounding part to form a loop between the feed part and the grounding part to expand the bandwidth frequency band, or to assist in tuning the frequency band to a frequency band with a better standing-wave ratio.

2. The multi-frequency antenna according to claim 1, wherein an electrical length of the second radiation branch arm is greater than that of the first radiation branch arm.

3. The multi-frequency antenna according to claim 2, wherein an electrical length of the first radiation branch arm is a quarter of a wavelength of a centre point of a first preset frequency band.

4. The multi-frequency antenna according to claim 3, wherein the first preset frequency band is 1,710 MHz to 2,170 MHz.

5. The multi-frequency antenna according to claim 2, wherein the electrical length of the second radiation branch arm is a quarter of a wavelength of a centre point of a second preset frequency band.

6. The multi-frequency antenna according to claim 5, wherein the second preset frequency band is 824 MHz to 960 MHz.

7. The multi-frequency antenna according to claim 1, wherein an electrical length of the third radiation branch arm is a quarter of a wavelength of a centre point of a third preset frequency band.

8. The multi-frequency antenna according to claim 1, wherein the first preset distance threshold value is 1 mm or 2 mm.

9. A terminal, comprising a multi-frequency antenna; wherein the multi-frequency antenna comprises an antenna body, wherein the antenna body comprises: a grounding part, a feed part, and a first radiation branch arm and a second radiation branch arm which are connected with the feed part; and the antenna body further comprises a third radiation branch arm; one end of the third radiation branch arm is connected with the feed part, and other end of the third radiation branch arm is connected with the grounding part; wherein the third radiation branch arm is configured to generate a harmonic with a frequency band to be expanded, or to assist in tuning the frequency band to a frequency band with a better standing-wave ratio;

wherein a clearance between the third radiation branch arm and the second radiation branch arm is less than or equal to a first preset distance threshold value, and the clearance affects a strength of a coupling existed between the third radiation branch arm and the second radiation branch arm;

wherein one end of the first radiation branch arm and one end of the second radiation branch arm are connected in parallel through a public part to form a whole to be connected with the feed part; other end of the first radiation branch arm and other end of the second radiation branch arm are led out of the public part along a cabling direction of the third radiation branch arm; the other end of the second radiation branch arm extends a certain length along the cabling direction of the third radiation branch arm, and then is backwards bent and extends a certain length again to form an inverted U shape; and the other end of the first radiation branch arm extends a certain length from the public part along the direction parallel to the third radiation branch arm to form an inverted G shape with the second radiation branch arm;

wherein one end of the third radiation branch arm is connected with the feed part through the public part and then connected in parallel with the first radiation branch arm and the second radiation branch arm; and other end of the third radiation branch arm is connected with the grounding part to form a loop between the feed part and the grounding part to expand the bandwidth frequency band, or to assist in tuning the frequency band to a frequency band with a better standing-wave ratio.

10. The terminal according to claim 9, wherein an electrical length of the second radiation branch arm is greater than that of the first radiation branch arm.

11. The terminal according to claim 10, wherein an electrical length of the first radiation branch arm is a quarter of a wavelength of a centre point of a first preset frequency band.

12. The terminal according to claim 11, wherein the first preset frequency band is 1,710 MHz to 2,170 MHz.

13. The terminal according to claim 10, wherein the electrical length of the second radiation branch arm is a quarter of a wavelength of a centre point of a second preset frequency band.

14. The terminal according to claim 13, wherein the second preset frequency band is 824 MHz to 960 MHz.

15. The terminal according to claim 9, wherein an electrical length of the third radiation branch arm is a quarter of a wavelength of a centre point of a third preset frequency band.

* * * * *